US011270714B2

(12) United States Patent
Clark

(10) Patent No.: US 11,270,714 B2
(45) Date of Patent: Mar. 8, 2022

(54) SPEECH CODING USING TIME-VARYING INTERPOLATION

(71) Applicant: Digital Voice Systems, Inc., Westford, MA (US)

(72) Inventor: Thomas Clark, Westford, MA (US)

(73) Assignee: Digital Voice Systems, Inc., Westford, MA (US)

( * ) Notice: Subject to any disclaimer, the term of this patent is extended or adjusted under 35 U.S.C. 154(b) by 0 days.

(21) Appl. No.: 16/737,543

(22) Filed: Jan. 8, 2020

(65) Prior Publication Data

US 2021/0210106 A1 Jul. 8, 2021

(51) Int. Cl.
*G10L 19/02* (2013.01)
*G10L 19/12* (2013.01)
*G10L 19/24* (2013.01)

(52) U.S. Cl.
CPC ..... *G10L 19/02* (2013.01); *G10L 19/12* (2013.01); *G10L 19/24* (2013.01)

(58) Field of Classification Search
CPC ..... G10L 19/02; G10L 19/12; G10L 19/24
See application file for complete search history.

(56) References Cited

U.S. PATENT DOCUMENTS 3,622,704 A 11/1971 Ferrieu et al.
3,903,366 A 9/1975 Coulter
(Continued)

FOREIGN PATENT DOCUMENTS

EP 0893791 A2 1/1999
EP 1020848 A2 7/2000
(Continued)

OTHER PUBLICATIONS

Mears, J.C. Jr, "High-speed error correcting encoder/decoder," IBM Technical Disclosure Bulletin USA, vol. 23, No. 4, Oct. 1980, pp. 2135-2136.
(Continued)

*Primary Examiner* — Bryan S Blankenagel
(74) *Attorney, Agent, or Firm* — Fish & Richardson P.C.

(57) ABSTRACT

Encoding a sequence of digital speech samples into a bit stream includes dividing the digital speech samples into frames including N subframes (where N is an integer greater than 1); computing model parameters for the subframes, the model parameters including spectral parameters; and generating a representation of the frame. The representation includes information representing the spectral parameters of P subframes (where P is an integer and P<N) and information identifying the P subframes. The representation excludes information representing the spectral parameters of the N−P subframes not included in the P subframes. Generating the representation includes selecting the P subframes by, for multiple combinations of P subframes, determining an error induced by representing the frame using the spectral parameters for the P subframes and using interpolated spectral parameter values for the N−P subframes, where the interpolated spectral parameter values are generated by interpolating using the spectral parameters for the P subframes. A combination of P subframes is selected based on the determined error for the combination of P subframes.

18 Claims, 8 Drawing Sheets

(56) References Cited

U.S. PATENT DOCUMENTS

| | | | |
|---|---|---|---|
| 4,847,905 | A | 7/1989 | Lefevre et al. |
| 4,932,061 | A | 6/1990 | Kroon et al. |
| 4,944,013 | A | 7/1990 | Gouvianakis et al. |
| 5,081,681 | A | 1/1992 | Hardwick et al. |
| 5,086,475 | A | 2/1992 | Kutaragi et al. |
| 5,193,140 | A | 3/1993 | Minde |
| 5,195,166 | A | 3/1993 | Hardwick et al. |
| 5,216,747 | A | 6/1993 | Hardwick et al. |
| 5,226,084 | A | 7/1993 | Hardwick et al. |
| 5,226,108 | A | 7/1993 | Hardwick et al. |
| 5,247,579 | A | 9/1993 | Hardwick et al. |
| 5,351,338 | A | 9/1994 | Wigren et al. |
| 5,491,772 | A | 2/1996 | Hardwick et al. |
| 5,517,511 | A | 5/1996 | Hardwick et al. |
| 5,581,656 | A | 12/1996 | Hardwick et al. |
| 5,630,011 | A | 5/1997 | Lim et al. |
| 5,649,050 | A | 7/1997 | Hardwick et al. |
| 5,657,168 | A | 8/1997 | Maruyama et al. |
| 5,664,051 | A | 9/1997 | Hardwick et al. |
| 5,664,052 | A | 9/1997 | Nishiguchi et al. |
| 5,696,874 | A | 12/1997 | Taguchi |
| 5,701,390 | A | 12/1997 | Griffin et al. |
| 5,715,365 | A | 2/1998 | Griffin et al. |
| 5,742,930 | A | 4/1998 | Howitt |
| 5,754,974 | A | 5/1998 | Griffin et al. |
| 5,826,222 | A | 10/1998 | Griffin |
| 5,870,405 | A | 2/1999 | Hardwick |
| 5,937,376 | A | 8/1999 | Minde |
| 5,963,896 | A | 10/1999 | Ozawa |
| 6,018,706 | A | 1/2000 | Huang et al. |
| 6,064,955 | A | 5/2000 | Huang et al. |
| 6,131,084 | A | 10/2000 | Hardwick |
| 6,161,089 | A | 12/2000 | Hardwick |
| 6,199,037 | B1 | 3/2001 | Hardwick |
| 6,377,916 | B1 | 4/2002 | Hardwick |
| 6,484,139 | B2 | 11/2002 | Yajima |
| 6,502,069 | B1 | 12/2002 | Grill et al. |
| 6,526,376 | B1 | 2/2003 | Villette et al. |
| 6,574,593 | B1 | 6/2003 | Gao et al. |
| 6,675,148 | B2 | 1/2004 | Hardwick |
| 6,895,373 | B2 | 5/2005 | Garcia et al. |
| 6,912,495 | B2 | 6/2005 | Griffin et al. |
| 6,931,373 | B1 | 8/2005 | Bhaskar et al. |
| 6,954,726 | B2 | 10/2005 | Brandel et al. |
| 6,963,833 | B1 | 11/2005 | Singhal |
| 7,016,831 | B2 | 3/2006 | Suzuki et al. |
| 7,289,952 | B2 | 10/2007 | Yasunaga et al. |
| 7,394,833 | B2 | 7/2008 | Heikkinen et al. |
| 7,421,388 | B2 | 9/2008 | Zinser et al. |
| 7,430,507 | B2 | 9/2008 | Zinser et al. |
| 7,519,530 | B2 | 4/2009 | Kaajas et al. |
| 7,529,660 | B2 | 5/2009 | Bessette et al. |
| 7,529,662 | B2 | 5/2009 | Zinser et al. |
| 2003/0135374 | A1 | 7/2003 | Hardwick |
| 2004/0093206 | A1 | 5/2004 | Hardwick |
| 2004/0117178 | A1* | 6/2004 | Ozawa ..... G10L 19/24 704/230 |
| 2004/0153316 | A1 | 8/2004 | Hardwick |
| 2005/0278169 | A1 | 12/2005 | Hardwick |
| 2010/0088089 | A1* | 4/2010 | Hardwick ..... G10L 13/02 704/208 |
| 2010/0094620 | A1 | 4/2010 | Hardwick |
| 2017/0325049 | A1 | 11/2017 | Basu Mallick et al. |

FOREIGN PATENT DOCUMENTS

| | | | |
|---|---|---|---|
| EP | 1237284 | A1 | 9/2002 |
| JP | HEI 05346797 | A | 12/1993 |
| JP | HEI 10293600 | A | 11/1998 |
| WO | 1998004046 | A2 | 1/1998 |

OTHER PUBLICATIONS

PCT International Search Authority, PCT Notification of Transmittal of the International Search Report and the Written Opinion of the International Searching Authority, or The Declaration, International Application No. PCT/US2021/012608, dated Mar. 31, 2021, 9 pages.

Shoham. "High-quality speech coding at 2.4 to 4.0 kbit/s based on time-frequency Interpolation," 1993 IEEE International Conference on Acoustics, Speech, and Signal Processing. Vol. 2. IEEE, 1993. Apr. 30, 1993 (Apr. 30, 1993) Retrieved on Mar. 9, 2021 (Mar. 9, 2021) from <https://ieeexplorejeee.org/abstract/document/319260> entire document.

* cited by examiner

SPEECH CODING USING TIME-VARYING INTERPOLATION

TECHNICAL FIELD

This description relates generally to the encoding and decoding of speech.

BACKGROUND

Speech encoding and decoding have a large number of applications. In general, speech encoding, which is also known as speech compression, seeks to reduce the data rate needed to represent a speech signal without substantially reducing the quality or intelligibility of the speech. Speech compression techniques may be implemented by a speech coder, which also may be referred to as a voice coder or vocoder.

A speech coder is generally viewed as including an encoder and a decoder. The encoder produces a compressed stream of bits from a digital representation of speech, such as may be generated at the output of an analog-to-digital converter having as an input an analog signal produced by a microphone. The decoder converts the compressed bit stream into a digital representation of speech that is suitable for playback through a digital-to-analog converter and a speaker. In many applications, the encoder and the decoder are physically separated, and the bit stream is transmitted between them using a communication channel.

A key parameter of a speech coder is the amount of compression the coder achieves, which is measured by the bit rate of the stream of bits produced by the encoder. The bit rate of the encoder is generally a function of the desired fidelity (i.e., speech quality) and the type of speech coder employed. Different types of speech coders have been designed to operate at different bit rates. For example, low to medium rate speech coders may be used in mobile communication applications. These applications typically require high quality speech and robustness to artifacts caused by acoustic noise and channel noise (e.g., bit errors).

Speech is generally considered to be a non-stationary signal having signal properties that change over time. This change in signal properties is generally linked to changes made in the properties of a person's vocal tract to produce different sounds. A sound is typically sustained for some short period, typically 10-100 ms, and then the vocal tract is changed again to produce the next sound. The transition between sounds may be slow and continuous or it may be rapid as in the case of a speech "onset." This change in signal properties increases the difficulty of encoding speech at lower bit rates since some sounds are inherently more difficult to encode than others and the speech coder must be able to encode all sounds with reasonable fidelity while preserving the ability to adapt to a transition in the characteristics of the speech signals. Performance of a low to medium bit rate speech coder can be improved by allowing the bit rate to vary. In variable-bit-rate speech coders, the bit rate for each segment of speech is allowed to vary between two or more options depending on various factors, such as user input, system loading, terminal design or signal characteristics.

One approach for low to medium rate speech coding is a model-based speech coder or vocoder. A vocoder models speech as the response of a system to excitation over short time intervals. Examples of vocoder systems include linear prediction vocoders such as MELP, homomorphic vocoders, channel vocoders, sinusoidal transform coders ("STC"), harmonic vocoders and multiband excitation ("MBE") vocoders. In these vocoders, speech is divided into short segments (typically 10-40 ms), with each segment being characterized by a set of model parameters. These parameters typically represent a few basic elements of each speech segment, such as the segment's pitch, voicing state, and spectral envelope. A vocoder may use one of a number of known representations for each of these parameters. For example, the pitch may be represented as a pitch period, a fundamental frequency or pitch frequency (which is the inverse of the pitch period), or a long-term prediction delay. Similarly, the voicing state may be represented by one or more voicing metrics, by a voicing probability measure, or by a set of voicing decisions. The spectral envelope may be represented by a set of spectral magnitudes or other spectral measurements. Since they permit a speech segment to be represented using only a small number of parameters, model-based speech coders, such as vocoders, typically are able to operate at medium to low data rates. However, the quality of a model-based system is dependent on the accuracy of the underlying model. Accordingly, a high fidelity model must be used if these speech coders are to achieve high speech quality.

An MBE vocoder is a harmonic vocoder based on the MBE speech model that has been shown to work well in many applications. The MBE vocoder combines a harmonic representation for voiced speech with a flexible, frequency-dependent voicing structure based on the MBE speech model. This allows the MBE vocoder to produce natural sounding unvoiced speech and makes the MBE vocoder robust to the presence of acoustic background noise. These properties allow the MBE vocoder to produce higher quality speech at low to medium data rates and have led to its use in a number of commercial mobile communication applications.

The MBE vocoder (like other vocoders) analyzes speech at fixed intervals, with typical intervals being 10 ms or 20 ms. The result of the MBE analysis is a set of MBE model parameters including a fundamental frequency, a set of voicing errors, a gain value, and a set of spectral magnitudes. The model parameters are then quantized at a fixed interval, such as 20 ms, to produce quantizer bits at the vocoder bit rate. At the decoder, the model parameters are reconstructed from the received bits. For example, model parameters may be reconstructed at 20 ms intervals, and then overlapping speech segments may be synthesized and added together at 10 ms intervals.

SUMMARY

Techniques are provided for reducing the bit rate, or improving the speech quality for a given bit rate, in a vocoder, such as a MBE vocoder. In such a vocoder, two ways to reduce the bit rate are reducing the number of bits per frame or increasing the quantization interval (or frame duration). In general, reducing the number bits per frame decreases the ability to accurately convey the shape of the spectral formants because the quantizer step size resolution begins to become insufficient. And decreasing the quantization interval reduces the time resolution and tends to lead to smoothing and a muffled sound.

Using current techniques, it is difficult to quantize the spectral magnitudes using fewer than 30-32 bits. Too much quantization negatively affects the formant characteristics of the speech and does not provide enough granularity for the parameters which change over time. In view of this, the described techniques increase the average time between sets of quantized spectral magnitudes rather than reducing the number of bits used to represent a set of spectral magnitudes.

In particular, sets of log spectral magnitudes are estimated at a fixed interval, then magnitudes are downsampled in a data dependent fashion to reduce the data rate. The downsampled magnitudes then are quantized and reconstructed, and the omitted magnitudes are estimated using interpolation. The spectral error between the estimated magnitudes and the reconstructed/interpolated magnitudes is measured in order to refine which magnitudes are omitted and to refine parameters for the interpolation.

So, for example, speech may be analyzed at a fixed interval of 10 ms, but the corresponding spectral magnitudes may be quantized at varying intervals that are an integer multiple of the analysis period. Thus, rather than quantizing the spectral magnitudes at a fixed interval, the techniques seek optimal points in time at which to quantize the spectral magnitudes. These points in time are referred to as interpolation points.

The analysis algorithms generate MBE model parameters at a fixed interval (e.g., 10 ms or 5 ms), with the points in time for which analysis has been used to produce a set of MBE model parameters being referred to as "analysis points" or subframes. Analysis subframes are grouped into frames at a fixed interval that is an integer multiple of the analysis interval. A frame is defined to contain N subframes. Downsampling is used to find P subframes within each frame that can be used to most accurately code the model parameters. Selection of the interpolation points is determined by evaluating the total quantization error for the frame for many possible combinations of interpolation point locations.

In one general aspect, encoding a sequence of digital speech samples into a bit stream includes dividing the digital speech samples into frames including N subframes (where N is an integer greater than 1); computing model parameters for the subframes, with the model parameters including spectral parameters; and generating a representation of the frame. The representation includes information representing the spectral parameters of P subframes (where P is an integer and P<N) and information identifying the P subframes. The representation excludes information representing the spectral parameters of the N−P subframes not included in the P subframes. The representation is generated by selecting the P subframes by, for multiple combinations of P subframes, determining an error induced by representing the frame using the spectral parameters for the P subframes and using interpolated spectral parameter values for the N−P subframes, the interpolated spectral parameter values being generated by interpolating using the spectral parameters for the P subframes, and selecting a combination of P subframes as the selected P subframes based on the determined error for the combination of P subframes.

Implementations may include one or more of the following features. For example, the multiple combinations of P subframes may include less than all possible combinations of P subframes. The model parameters may be model parameters of a Multi-Band Excitation speech model, and the information identifying the P subframes may be an index.

Generating the interpolated spectral parameter values for the N−P subframes may include interpolating using the spectral parameters for the P subframes and spectral parameters from a subframe of a prior frame.

Determining an error for a combination of P subframes may include quantizing and reconstructing the spectral parameters for the P subframes, generating the interpolated spectral parameter values for the P−N subframes, and determining a difference between the spectral parameters for the frame including the P subframes and a combination of the reconstructed spectral parameters and the interpolated spectral parameters. Selecting the combination of P subframes may include selecting the combination that induces the smallest error.

In another general aspect, a method for decoding digital speech samples from a bit stream includes dividing the bit stream into frames of bits and extracting, from a frame of bits, information identifying, for which P of N subframes of a frame represented by the frame of bits (where N is an integer greater than 1, P is an integer, and P<N), spectral parameters are included in the frame of bits, and information representing spectral parameters of the P subframes. Spectral parameters of the P subframes are reconstructed using the information representing spectral parameters of the P subframes; and spectral parameters for the remaining N−P subframes of the frame of bits are generated by interpolating using the reconstructed spectral parameters of the P subframes.

Generating spectral parameters for the remaining N−P subframes of the frame of bits may include interpolating using the reconstructed spectral parameters of the P subframes and reconstructed spectral parameters of a subframe of a prior frame of bits.

In another general aspect, a speech coder is operable to encode a sequence of digital speech samples into a bit stream using the techniques described above. The speech coder may be incorporated in a communication, such as a handheld communication device, that includes a transmitter for transmitting the bit stream.

In another general aspect, a speech decoder is operable to decode a sequence of digital speech samples from a bit stream using the techniques described above. The speech decoder may be incorporated in a communication, such as a handheld communication device, that includes a receiver for receiving the bit stream and a speaker connected to the speech decoder to generate audible speech based on digital speech samples generated using the reconstructed spectral parameters and the interpolated spectral parameters.

Other features will be apparent from the following description, including the drawings, and the claims.

DETAILED DESCRIPTION

Figure 1:
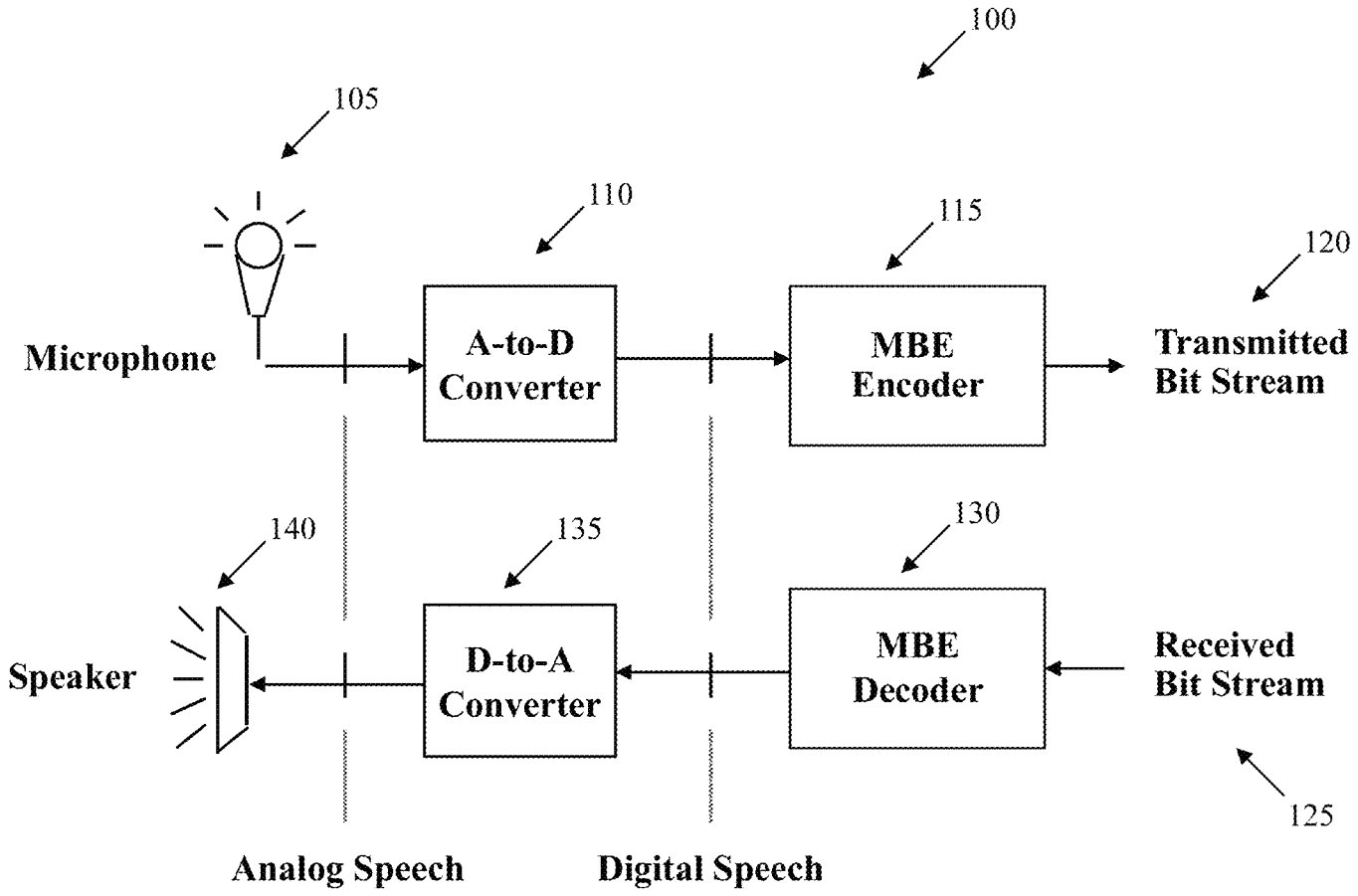
FIG. 1 is a block diagram of an application of a MBE vocoder.

FIG. 1 shows a speech coder or vocoder system 100 that samples analog speech or some other signal from a microphone 105. An analog-to-digital ("A-to-D") converter 110 digitizes the sampled speech to produce a digital speech signal. The digital speech is processed by a MBE speech encoder unit 115 to produce a digital bit stream 120 suitable for transmission or storage. The speech encoder processes the digital speech signal in short frames. Each frame of digital speech samples produces a corresponding frame of bits in the bit stream output of the encoder.

FIG. 1 also depicts a received bit stream 125 entering a MBE speech decoder unit 130 that processes each frame of bits to produce a corresponding frame of synthesized speech samples. A digital-to-analog ("D-to-A") converter unit 135 then converts the digital speech samples to an analog signal that can be passed to a speaker unit 140 for conversion into an acoustic signal suitable for human listening.

Figure 2:
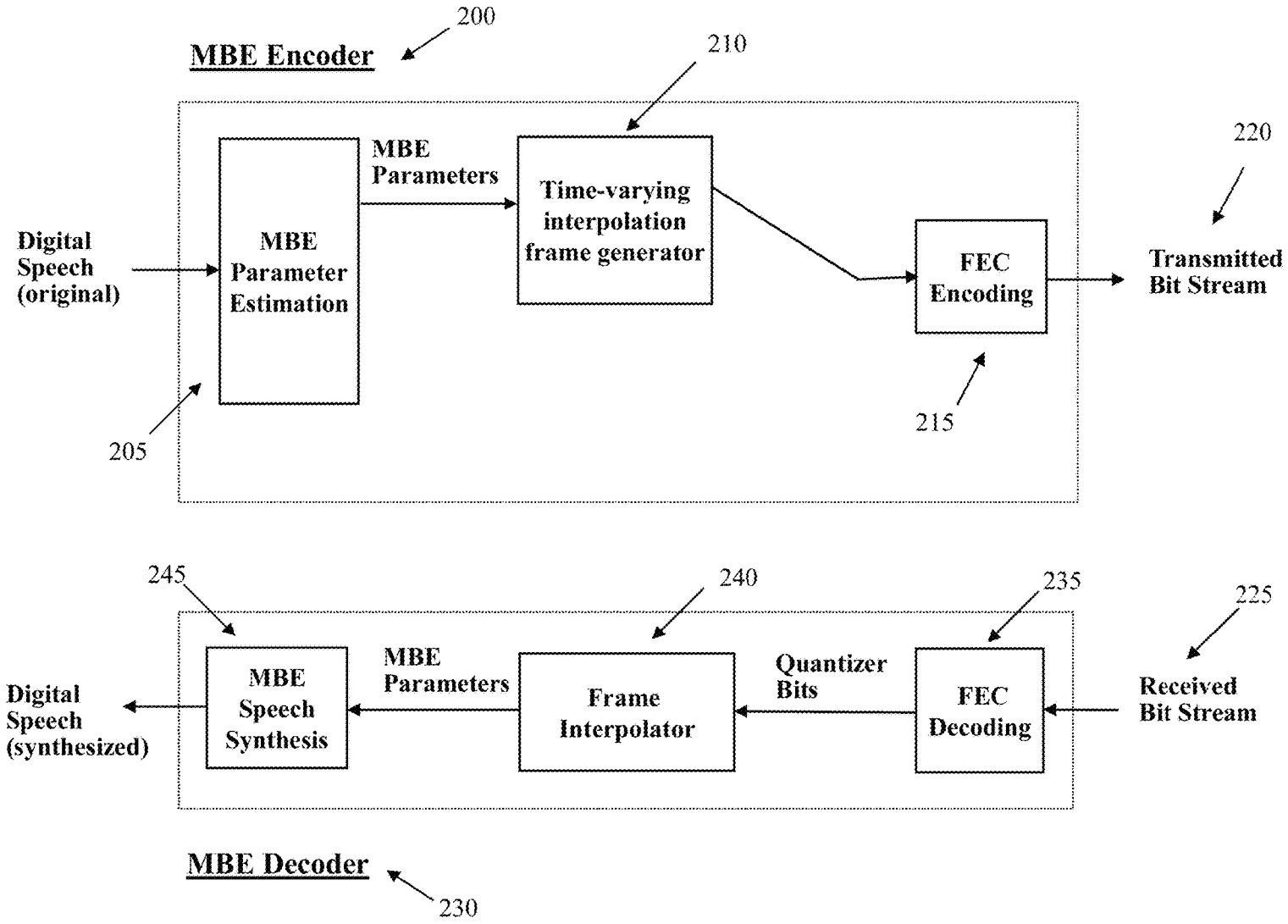
FIG. 2 is a block diagram of an implementation of a MBE vocoder employing time-varying interpolation points.

FIG. 2 shows a MBE vocoder that includes a MBE encoder unit 200 that employs time-varying interpolation points. In the MBE encoder unit 200, a parameter estimation unit 205 estimates generalized MBE model parameters at fixed intervals, such as 10 ms intervals, that may also be referred to as subframes. The MBE model parameters include a fundamental frequency, a set of voicing errors, a gain value, and a set of spectral magnitudes. While the discussion below focuses on processing of the spectral magnitudes, it should be understood that the bits representing a frame also include bits representing the other model parameters.

Using the MBE model parameters, a time-varying interpolation frame generator 210 then generates quantizer bits for a frame including a collection of N subframes, where N is an integer greater than one. For example, the frame generator 210 may generate quantizer bits for a 50 ms frame that includes five 10 ms subframes (N=5). However, rather than quantize the spectral magnitudes for all of the N subframes, the frame generator only quantizes the spectral magnitudes for P subframes, where P is an integer less than N. Thus, rather than quantizing the spectral magnitudes at a fixed interval, the frame generator 210 seeks optimal points in time at which to quantize the spectral magnitudes. These points in time may be referred to as interpolation points. The frame generator selects the interpolation points by evaluating the total quantization error for the frame for many possible combinations of interpolation point locations.

In general, the frame generator 210 can be used to produce P interpolation points per frame. If every frame includes N analysis subframes, then the number of combinations of interpolation points per frame is determined from the binomial theorem as $K=N!/((N-P)!\cdot P!)$. The frame generator 210 evaluates, for each combination of interpolation point locations considered, the effects of downsampling the magnitudes at the N subframes to magnitudes at P subframes, quantizing the magnitudes for those P subframes, and then using interpolation to fill back in the magnitudes for the unquantized subframes.

For example, in a system where the parameter estimation unit 205 produces a set of MBE model parameters every 10 ms, with a 50 ms frame size (N=5), there are five subframes, or analysis points, per frame, and the frame generator 210 may identify two interpolation points per frame for spectral magnitude quantization (P=2).

The spectral magnitude information from N subframes can be conveyed by the spectral magnitude information at P subframes if interpolation is used to fill in the spectral magnitudes for the analysis points that were omitted. For this system, the average time between interpolation points is 25 ms, the minimum distance between interpolation points is 10 ms, and the maximum distance is 70 ms. In particular, if analysis points for which MBE model parameters are represented by quantized data are denoted by 'x' and analysis points for which the MBE model parameters are resolved by interpolation are denoted by '-', then for this particular example there are 10 choices for the interpolation points:

x x - - -
x - x - -
x - - x -
x - - - x
- x x - -
- x - x -
- x - - x
- - x x -
- - x - x
- - - x x

Note that it would require four bits to code all ten of the possible interpolation point combinations. To reduce the number of bits required, some of the possibilities may be omitted from consideration. For example, the first and last cases ("x x - - -" and "- - - x x") may be omitted, which would then reduce the number of possible combinations down to eight, which can be represented with three coding bits.

The frame generator 210 quantizes the spectral magnitudes at the interpolation points and combines them with the locations of the interpolation points, which are coded using, for example, three bits as noted above, and the other MBE parameters for the frame to produce the quantized MBE parameters for the frame.

An FEC encoder 215 receives the quantized MBE parameters and encodes them using error correction coding to produce the bit stream 220 for transmission for receipt as a received bit stream 225. The FEC encoder 215 combines the quantizer bits with redundant forward error correction ("FEC") data to produce the bit stream 220. The addition of redundant FEC data enables the decoder to correct and/or detect bit errors caused by degradation in the transmission channel.

A MBE decoder unit 230 receives the bit stream 225 and uses an FEC decoder 235 to decode the received bit stream 225 and produce quantized MBE parameters.

A frame interpolator 240 uses the quantized MBE parameters and, in particular, the quantized spectral magnitudes at the interpolation points and the locations of the interpolation points to generate interpolated spectral magnitudes for the N−P subframes that were not encoded. In particular, the frame interpolator 240 reconstructs the MBE parameters from the quantized parameters, generates the interpolated spectral magnitudes, and combines the reconstructed parameters with the interpolated spectral magnitudes to produce a set of MBE parameters. The frame interpolator 240 uses the same interpolation technique employed by the frame generator 210 to find the optimal interpolation points to interpolate between the spectral magnitudes.

An MBE speech synthesizer 245 receives the MBE parameters and uses them to synthesize digital speech.

Figure 3:
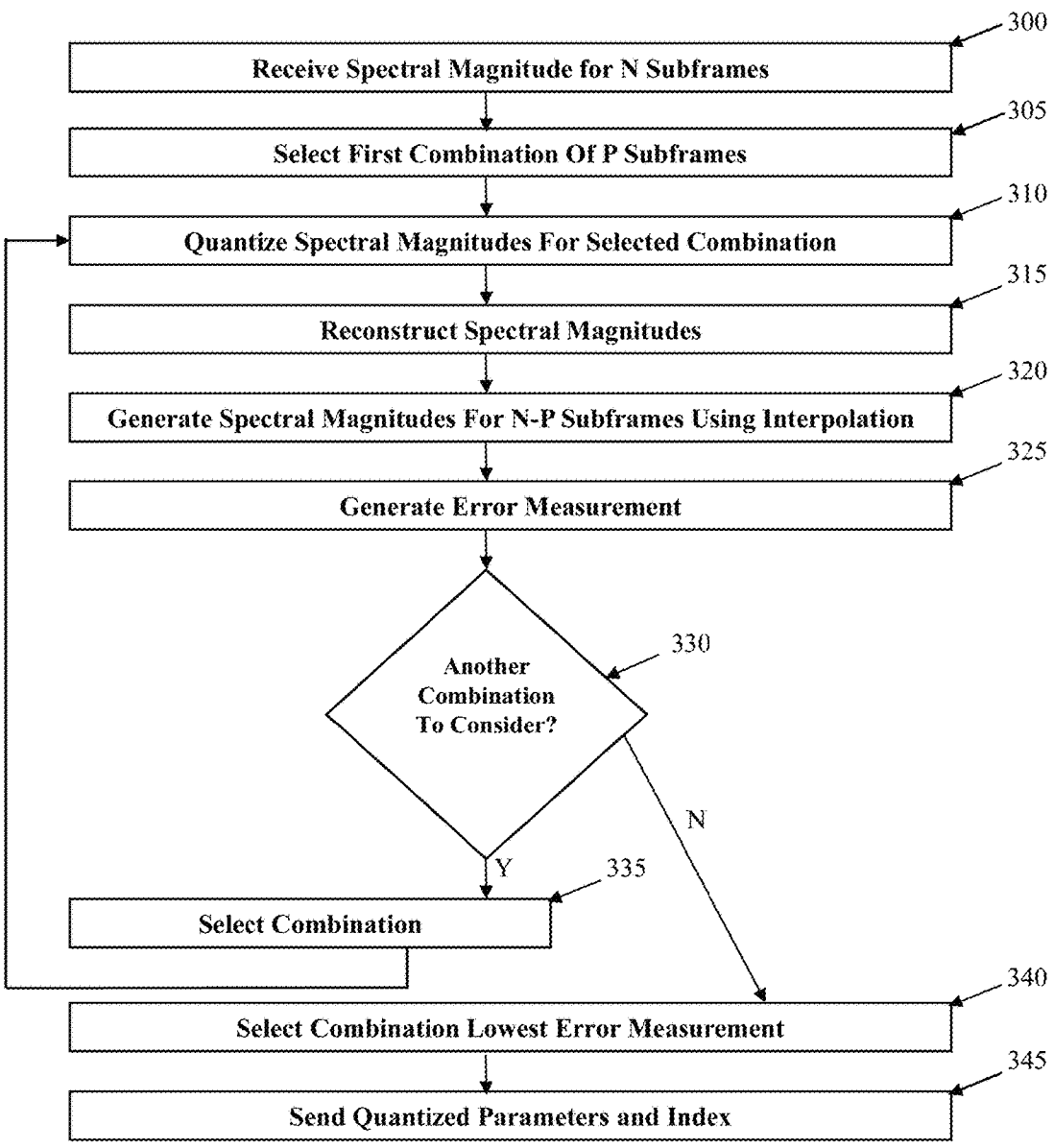
FIG. 3 is a flow chart showing operation of a frame generator.

Referring to FIG. 3, in operation, the frame generator 210 receives the spectral magnitudes for the N subframes of a frame (step 300). The frame generator 210 then iteratively repeats the same interpolation technique used by the frame interpolator 240 to reconstruct the magnitudes from the quantized bits and to interpolate between the magnitudes at the sampling points to reform the points that were omitted during downsampling. In this way, the encoder effectively evaluates many possible decoder outcomes and selects the outcome that will produce the closest match to the original magnitudes.

In more detail, after receiving the spectral magnitudes, the frame generator 210 selects the first available combination of P subframes (e.g., "x - x - -") (step 305) and quantizes the spectral magnitudes for that combination of P subframes (step 310). Thus, in the case of the combination "x - x - -", the frame generator 210 would quantize the first and third subframes to generate quantized bits. The frame generator 210 then reconstructs the spectral magnitudes from the quantized bits (step 315) and generates representations of the spectral magnitudes of the other subframes (i.e., the second, fourth and fifth subframes in this example) by interpolating between the spectral magnitudes reconstructed from the quantized bits (step 320). For example, the interpolation may involve generating the spectral magnitudes using, for example, linear interpolation of magnitudes, linear interpolation of log magnitudes, or linear interpolation of magnitudes squared. As one illustrative example of these techniques, when the reconstructed magnitudes at endpoints for one particular harmonic are 8 and 16, and the interpolation subframe is halfway between the reconstructed subframe, the interpolated magnitude would be (8+16)/2=12; the log 2 magnitude would be 3 and 4, the interpolated log 2 magnitude would be 3.5, and the interpolated magnitude would be 2^3.5=11.3; and the magnitudes squared would be 64 and 256, the interpolated squared magnitude would be (64+256)/2=160, and the interpolated magnitude would be square root of 160=12.6. In each of these cases, the interpolated magnitude (12, 11.3, and 12.6) are between the endpoints (8 and 16).

In more detail, for this example, the frame generator 210 generates a representation of the second subframe by interpolating between the reconstructed spectral magnitudes of the first and third subframes, and generates a representation for each of the fourth and fifth subframes by interpolating between the reconstructed spectral magnitudes of the third subframe and reconstructed spectral magnitudes of the first subframe of the next frame. The frame generator 210 then compares the reconstructed spectral magnitudes and the interpolated spectral magnitudes to generate an error measurement that compares the "closeness" of the down-sampled, quantized, reconstructed, and interpolated magnitudes with the original magnitudes (step 325).

If there is another available combination of P subframes to be considered (step 330), the frame generator selects that combination of P subframes (step 335) and repeats steps 310-325. For example, after generating the error measurement for "x - x - -", the frame generator 210 generates an error measurement for "x - - x -".

If there are no more available combinations of P subframes to be considered (step 330), the frame generator 210 selects the combination of P subframes that has the lowest error measurement (step 340) and sends the quantized parameters for that combination of P subframes along with an index that identifies the combination of P subframes to the FEC encoder 215 (step 345).

Figure 4:
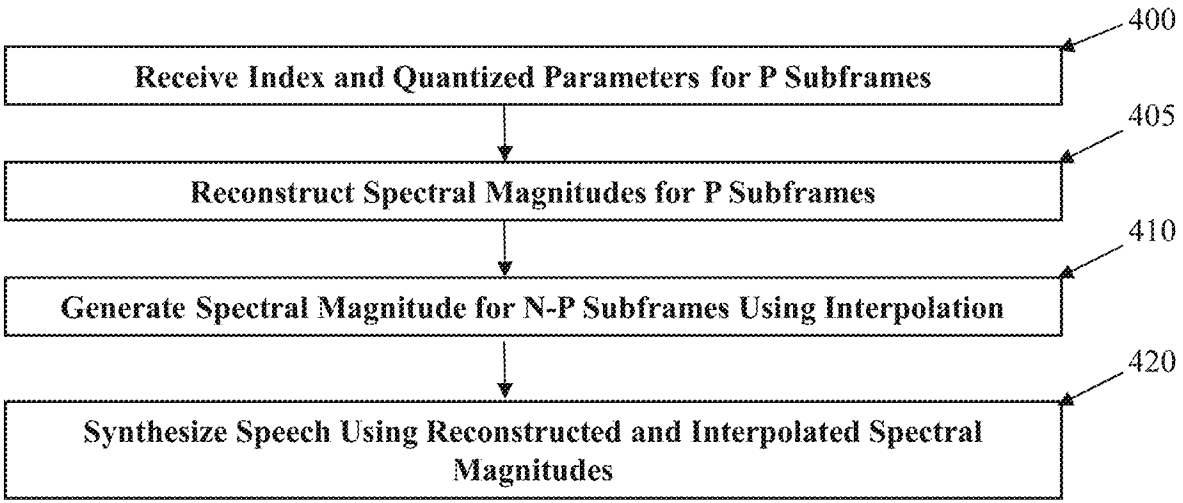
FIG. 4 is a flow chart showing operation of a frame interpolator.

As shown in FIG. 4, frame interpolator 240 receives the index and the quantized parameters for P subframes (step 400) and reconstructs the spectral magnitudes for the P subframes from the received quantized parameters (step 405). The frame interpolator 240 then generates the spectral magnitudes for the remaining N−P subframes by interpolating between the reconstructed spectral magnitudes (step 410). For subframes after the last of the P subframes, the frame interpolator waits until receipt of the index and the quantized parameters of the P subframes for the next frame before interpolating the spectral magnitudes for those subframes. For example, in the example discussed above, where the P subframes are the first and third subframes, the frame interpolator generates spectral magnitudes of the second subframe by interpolating between the reconstructed spectral magnitudes of the first and third subframes, and then generates a representation for each of the fourth and fifth subframes by interpolating between the reconstructed spectral magnitudes of the third subframe and the reconstructed spectral magnitudes of the first of the P subframes of the next frame.

Finally, the decoder uses the reconstructed and interpolated spectral magnitudes to synthesize speech (step 420).

While the example above describes a system that employs 50 ms frames, 10 ms subframes (such that N equals 5) and two interpolation points (P equals 2), these parameters may be varied. For example, the analysis interval between sets of estimated log spectral magnitudes can be increased or decreased such as, for example, by increasing the length of a subframe from 20 ms or decreasing the length of a subframe from 10 ms to 5 ms. In addition, the number of analysis points per frame (N) and the number of interpolation points per frame (P) may be varied. These parameters may be varied when the system is initially configured or they may be varied dynamically during operation based on changing operating conditions.

The techniques described above may be implemented in the context of an AMBE vocoder. A typical implementation of an AMBE vocoder using a 20 ms frame size without using time varying interpolation points has an overall coding/encoding delay of 72 ms. A similar AMBE vocoder using a frame size of N*10 ms without using time varying interpolation points has a delay of N*10+52 ms. In general, the use of variable interpolation points adds (N−P)*10 ms of delay such that the delay becomes N*20−P*10+52 ms. Note that the N−P subframes of delay is added by the decoder. After receiving a frame of quantized bits, the decoder is only able to reconstruct subframes up through the last interpolation point. In the worst case, the decoder will only reconstruct P subframes (the remaining N−P subframes will be generated after receiving the next frame). Due to this delay, the decoder keeps model parameters from up to (N−P) subframes in a buffer. In a typical software implementation, the decoder will use model parameters from the buffer along with model parameters from the most recent subframe such that N or more subframes of model parameters are available for speech synthesis. Then it will synthesize speech for N subframes and place the model parameters for any remaining subframes in the buffer.

However, the delay may be reduced by one or two subframe intervals by adjusting the techniques such that the magnitudes for the most recent one or two subframes use the estimated fundamental frequency from a prior subframe. The delay, D, is therefore confined to a range:

$$(N*2-P)*I+32\text{ ms}<D<((N+1)*2-P)*I+32\text{ ms}$$

Where I is the subframe interval and is typically 10 ms. The delay may be reduced further by restricting interpolation point candidates, but this may result in reduced voice quality.

Figure 5:
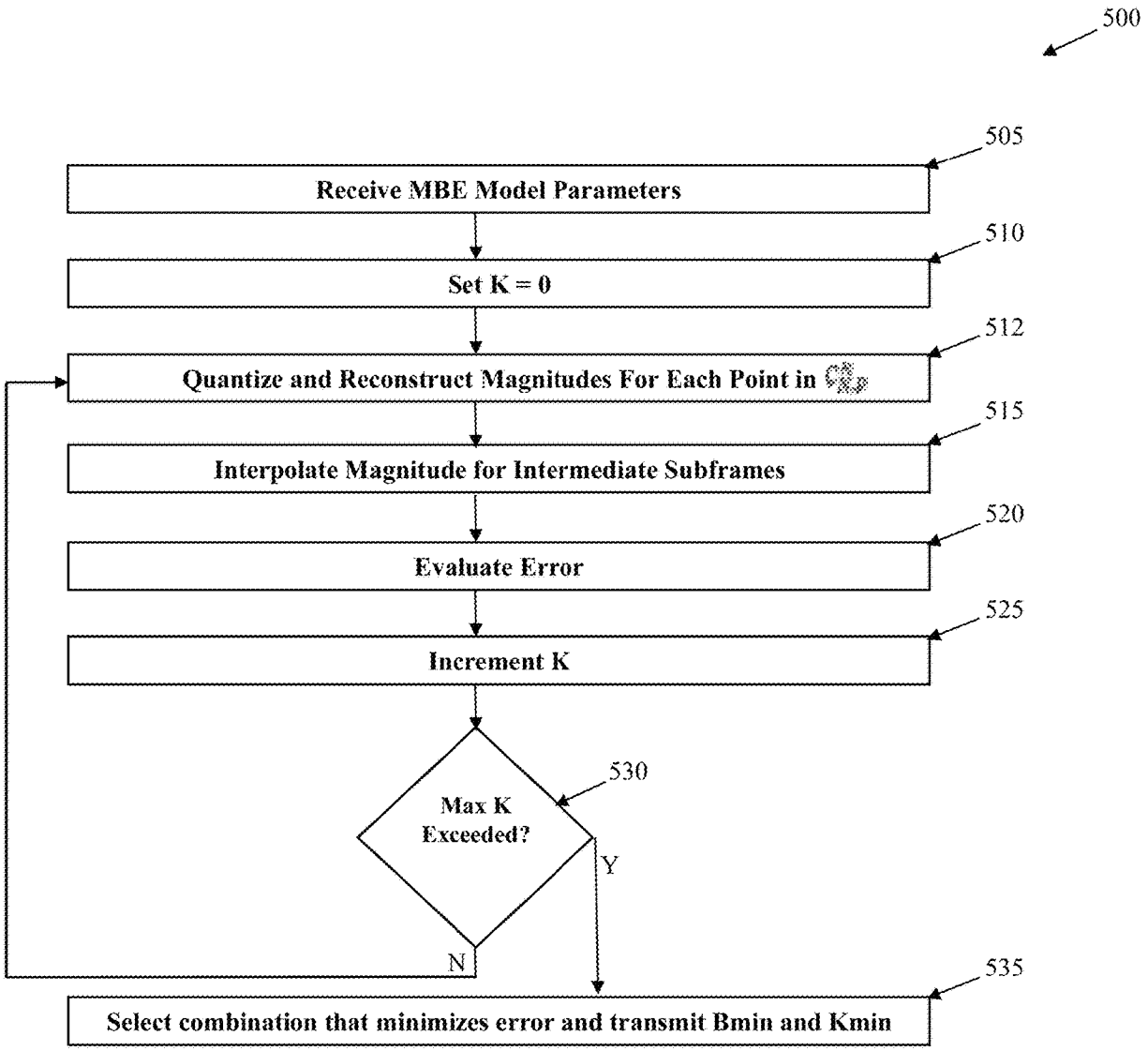
FIG. 5 is a flow chart showing operation of a frame generator.

Referring to FIG. 5, generation of parameters using time varying interpolation points is conducted according to a procedure 500 that begins with receipt of a set of MBE model parameters estimated for each subframe within a frame (step 505). The parameters include fundamental frequency, gain, voicing decisions, and log spectral magnitudes. In this described example, the duration of a subframe is usually 10 ms, though that is not a requirement. The number of subframes per frame is denoted by N, and the number of interpolation points per frame is denoted by P, where P<N. The objective of the procedure 500 is to find a subset of the N subframes containing P subframes, such that interpolation can reproduce the spectral magnitudes of all N subframes from the subset of subframes with minimal error.

The procedure proceeds by evaluating an error for many possible combinations of interpolation point locations. The total number of possible interpolation point combinations, from the binomial theorem, is $$K = \frac{N!}{(N-P)!P!},$$

where N is the number of subframes per frame and P is the number of interpolation points per frame. In some cases, it might be desirable to consider only a subset of the possible combinations.

In the discussion below, M(0) through M(N−1) denote the log 2 spectral magnitudes for subframes 0 through N−1. In this context, 0 and N−1 are referred to as subframe indices. The spectral magnitudes are represented at L harmonics, where the number of harmonics is variable between 9 and 56 and is dependent upon the fundamental frequency of the subframe. When it is useful to denote the magnitude of a particular harmonic, a subscript is used. For example, $M_l(0)$, denotes the magnitude of the lth harmonic of subframe 0. Estimated magnitudes from a prior frame are denoted using negative subframe indices For example, subframes 0 through N−1 from the prior frame are denoted as subframes −N through −1 (i.e., N is subtracted from each subframe index).

After the magnitudes for subframe n have been quantized and reconstructed they are denoted by $\overline{M}(n)$. $\overline{M}(n)$ is also used to denote the magnitudes that are obtained by interpolating between the quantized and reconstructed magnitudes at two interpolation points.

Since an iterative procedure is used to evaluate an error for k different sets of interpolation points, it is necessary to distinguish the quantized/reconstructed/interpolated magnitudes of each candidate. To address this, $\overline{M}_l(n)^k$ denotes the kth candidate for the magnitude at the lth harmonic of the nth subframe.

The procedure 500 requires that MBE model parameters have been estimated for subframes −(N−P) through N. The total number of subframes is thus 2·N−P+2. M(1) through M(N) are the spectral magnitudes from most recent N subframes.

The objective of the procedure 500 is to downsample the magnitudes and then quantize them so that the information can be conveyed using a lower data rate. Note that downsampling and quantization are each a method of reducing data rate. A proper combination of downsampling and quantization can be used to achieve the least impact on voice quality. A close representation of the original magnitudes can be obtained by reversing these steps. The quantized bits are used to reconstruct the spectral magnitudes for the subframes that they were sampled from. Then the magnitudes that were omitted during the downsampling process are reformed using interpolation. The objective is to choose a set of interpolation points such that when the magnitudes at those subframes are quantized and reconstructed and the magnitudes at the subframes that fall between the interpolation points are reconstructed by interpolation, the resulting magnitudes are "close" to the original estimated magnitudes.

The equation used for measuring "closeness" is as follows:

$$e^k = \Sigma_{n=d}^{N} w(n) \Sigma_{l=0}^{L(n)} \left(M_l(n) - \overline{M}_l(n)^k\right)^2 \quad \text{for } 0 \le k < K$$

In this equation, $M_l(n)$ represent the estimated spectral magnitudes for each subframe and $\overline{M}_l(n)$ represent the spectral magnitudes after they have been down sampled, quantized, reconstructed, and interpolated. And w(n) may be expressed as:

$$w(n) = \left\{0.5 + \frac{0.5 \cdot (g(n) - g(\min))}{g(\max) - g(\min)}\right\}^2$$

where g(n) is the gain for the subframe and is computed as follows:

$$g(n) = \frac{\Sigma_{l=0}^{L(n)} M_l(n)}{L(n)}$$

And g(max) and g(min) are the maximum and minimum gains for Λ≤n≤N, and w(n) represents a weight between 0.25 and 1.0 that gives more importance to subframes that have greater gain.

The procedure 500 needs to evaluate the magnitudes, associated quantized magnitude data, reconstructed magnitudes, and the associated error for all permitted combinations of "sampling points," where the sampling points correspond to the P subframes at which the spectral magnitudes will be quantized for every N subframes of spectral magnitudes that were estimated. Rather than being chosen arbitrarily, the sampling points are chosen in a manner that minimizes the error.

With k being the magnitude sampling index, the number of possible combinations of sampling points is K=N!/((N−P)!·P!).

For a system where N=5, P=2, and K=10, the amount of magnitude data may be reduced by 60% (from 5 subframes down to 2). To reverse the downsampling process, interpolation is used to estimate the magnitudes at the unquantized subframes. The magnitude sampling index, k, must be transmitted from the encoder to the decoder such that the decoder will know the location of the sampling points. For N=5, P=2, and K=10, a 4-bit k-value would need to be transmitted to the decoder. The terms "magnitude sampling index" or "k-value" can be used interchangeably as needed.

$M_l(n)$, where 0≤n<N denote the spectral magnitudes at N equidistant points in time. $M_l(N)$ denotes the spectral magnitudes at the next interval. Also, $M_l(n)$, where −(N−P+1) ≤n<0, denote the prior spectral magnitudes.

The procedure 500 selects P points from subframes 0 . . . N−1 at which the magnitudes are sampled. The magnitudes at intervening points are filled in using interpolation. Each combination of interpolation points is denoted using a set of P elements:

$$T^k = \{n_0, n_1, \ldots, n_{p-1}\}$$

where $0 \le n_p < N$ are the subframe indices of the interpolation points.

For example, when N=5, P=2, there are K=10 combinations of points to consider:

$T^0=\{0,1\}$,
$T^1=\{0,2\}$,
$T^2=\{0,3\}$,
$T^3=\{0,4\}$,
$T^4=\{1,2\}$,
$T^5=\{1,3\}$,
$T^6=\{1,4\}$,
$T^7=\{2,3\}$,
$T^8=\{2,4\}$,
$T^9=\{3,4\}$

Each of the above sets represent one possible combination of interpolation points to be evaluated in this example.

In this example, also assume that, in the prior frame, subframe, index 3 was chosen as the second interpolation point. Since 3-N=−2, Λ=−2 is used as the subframe index for the prior frame, such that $\overline{M}(\Lambda=-2)$ are the quantized spectral magnitudes for subframe 3 in the prior frame.

M(N=5) are the spectral magnitudes for subframe 5 (which also may be referred to as the first subframe of the next frame). While subframe index N is not an eligible location for the interpolation point of the current frame, the magnitudes for the subframe are required by the algorithm that selects the interpolation points.

Each set in $T^k$ is extended to contain subframe indices Λ and N, so for this example, the extended sets are:

$C^0=\{-2,0,1,5\}$,
$C^1=\{-2,0,2,5\}$,
$C^2=\{-2,0,3,5\}$,
$C^3=\{-2,0,4,5\}$,
$C^4=\{-2,1,2,5\}$,
$C^5=\{-2,1,3,5\}$,
$C^6=\{-2,1,4,5\}$,
$C^7=\{-2,2,3,5\}$,
$C^8=\{-2,2,4,5\}$,
$C^9=\{-2, 3,4, 5\}$ $C^0$-$C^9$ in this example represent the K=10 combinations of interpolation points that need to be evaluated. Also note that since Λ can change every frame, the first element of $C^k$ can change every frame.

To improve the notation, and allow it to be adapted for arbitrary N, P, and K, the set $\Theta_{N,P}{}^k$ may be defined to be the kth combination of subframe indices where there are N subframes per frame with P interpolation subframes per frame. Following are $\Theta_{N,P}{}^k$ sets for varying values of N and P:

$$\theta^0_{2,1}=\{0\},\ \theta^1_{2,1}=\{1\}$$

$$\theta^0_{3,1}=\{0\},\ \theta^1_{3,1}=\{1\},\ \theta^2_{3,1}=\{2\}$$

$$\theta^0_{4,1}=\{0\},\ \theta^1_{4,1}=\{1\},\ \theta^2_{4,1}=\{2\},\ \theta^2_{4,1}=\{3\}$$

$$\theta^0_{3,2}=\{0,\ 1\}\theta^1_{3,2}=\{0,\ 2\}\theta^2_{3,2}=\{1,\ 2\}$$

$$\theta^k_{4,2}=\{0,\ 1\},\ \{0,\ 2\},\ \{0,\ 3\},\ \{1,\ 2\},\ \{1,\ 3\},\ \{2,\ 3\}$$

$$\theta^k_{5,2}=\begin{matrix}\{0,\ 1\},\ \{0,\ 2\},\ \{0,\ 3\},\ \{0,\ 4\},\ \{1,\ 2\},\\ \{1,\ 3\},\ \{1,\ 4\},\ \{2,\ 3\},\ \{2,\ 4\},\ \{3,\ 4\}\end{matrix}$$

$$\theta^k_{4,3}=\{0,\ 1,\ 2\},\ \{0,\ 1,\ 3\},\ \{0,\ 2,\ 3\},\ \{1,\ 2,\ 3\}$$

$$\theta^k_{5,3}=\begin{matrix}\{0,\ 1,\ 2\}, & \{0,\ 1,\ 3\}, & \{0,\ 1,\ 4\}, & \{0,\ 2,\ 3\}, & \{0,\ 2,\ 4\},\\ \{0,\ 3,\ 4\}, & \{1,\ 2,\ 3\}, & \{1,\ 2,\ 4\}, & \{1,\ 3,\ 4\}, & \{2,\ 3,\ 4\}\end{matrix}$$

$$\theta^k_{6,3}=\begin{matrix}\{0,\ 1,\ 2\}, & \{0,\ 1,\ 3\}, & \{0,\ 1,\ 4\}, & \{0,\ 1,\ 5\}, & \{0,\ 2,\ 3\},\\ \{0,\ 2,\ 4\}, & \{0,\ 2,\ 5\}, & \{0,\ 3,\ 4\}, & \{0,\ 3,\ 5\}, & \{0,\ 4,\ 5\},\\ \{1,\ 2,\ 3\}, & \{1,\ 2,\ 4\}, & \{1,\ 2,\ 5\}, & \{1,\ 3,\ 4\}, & \{1,\ 3,\ 5\},\\ \{1,\ 4,\ 5\}, & \{2,\ 3,\ 4\}, & \{2,\ 3,\ 5\}, & \{2,\ 4,\ 5\}, & \{3,\ 4,\ 5\}\end{matrix}$$

The pattern can be continued to compute $\Theta_{N,P}{}^k$ for any other values of N and P, where N>P.

Using this, the combinations of interpolation points that need to be evaluated can be defined as:

$$C_{N,P}{}^k=\{\Lambda,\Theta_{N,P}{}^k\}\ \text{for}\ 0\le k<K$$

to be k sets of subframe indices, where each set has P+2 indices and the first index in each combination set is always Λ, which is derived from the final magnitude interpolation index (k-value) in the last frame. In addition, P−N≤λ<0 and N>P. Since A varies from frame to frame, the first index in each $C_{N,P}{}^k$ will also vary. The last index in each combination set is always N.

With the context of this notation, the procedure 500 proceeds by setting k to 0 (step 510) and, for each point in $C_{N,P}{}^k$, quantizing and reconstructing the magnitudes (step 512).

An exemplary implementation of a magnitude quantization and reconstruction technique is described in APCO Project 25 Half-Rate Vocoder Addendum, TIA-102.BABA-1, which is incorporated by reference. The quantization and reconstruction produces:

$$\overline{M}_l(n)=\text{Quant}^{-1}(\text{Quant}(M_l(n)))\ \text{for each}\ n\ \text{in the set}\ C^k$$

The procedure 500 then interpolates the magnitudes for the intermediate subframes (i.e., n not in the set $C^k$) using a weighted sum of the magnitudes at the end points (step 515). The magnitudes for the starting subframe are denoted by $\overline{M}_l(s)$, and the magnitudes for the ending subframe are denoted by $\overline{M}_l(e)$. The magnitudes for intermediate subframes, $\overline{M}_l(i)$, are approximated as follows for 0≤l<L(i):

$$\overline{M}_l(t)=\begin{cases} TBD & \text{when } x-p-x \\ \frac{e-t}{e-s}\cdot M^1{}_l(s)+\frac{i-s}{e-s}\cdot M'_l(e) & \text{when } v-v-v,\ v-u-v,\ v-p-v \\ M'_l\ (s) & \text{when } v-v-u \text{ or } v-v-p \\ M'_l(e) & \text{when } v-u-u \\ \min(M'_l(s),\ M'_l(e)) & \text{when } v-u-p \\ M'_l(e) & \text{when } u-v-v, \text{ or } p-v-v \\ M'_l(s) & \text{when } u-u-v \\ \min(M'_l(s),\ M'_l(e)) & \text{when } p-u-v \\ \frac{e-i}{e-s}\cdot M'_l(s)+\frac{i-s}{e-s}\cdot M'_l(e) & \text{otherwise} \end{cases}$$

Where $M'_l(s)$ and $M'_l(e)$ are derived from $\overline{M}(s)$ and $\overline{M}(e)$ using the equations that follow.

For each harmonic, l, the interpolation equation is dependent on whether the voicing type for the first end point, intermediate point, and final end point are voiced ("v"), unvoiced ("u"), or pulsed ("p"). For example "when v-u-u", is applicable when the lth harmonic of the first subframe is voiced, and the lth harmonic of the intermediate subframe is unvoiced, and the lth harmonic of the final subframe is unvoiced.

Since the number of harmonics, L, (and fundamental frequency) at subframe index i may not be the same as those parameters at subframes s and e, the magnitudes at subframes s and e need to be resampled.

$$M'_l(x)=\overline{M}_{n_l}(x)\cdot(1-k_l)+\overline{M}_{n_l+1}(x)\cdot k_l\ \text{for}\ x=s\ \text{or}\ x=e$$

Where integer indices, $n_l(i)$ for each harmonic, are computed as follows $$n_l(t) = \left\lfloor \frac{f(t)}{f(x)} \cdot l \right\rfloor \text{ for } s < 1 < e,\ 0 \le l < L(t)$$

Where f(i) is the fundamental frequency for subframe i and f(x) is the fundamental frequency for subframe x, where x is either s or e. For each harmonic, weights, $k_l(i)$, are derived as follows:

$$k_l(t) = \frac{f(t)}{f(x)} \cdot l - n_l(t) \text{ for } s < 1 < e,\ 0 \le l < L(t)$$

Continuing with the example that N=5, P=2, Λ=−2 to show how the equations are applied, the following sets of magnitudes may be formed by grouping the magnitudes at each subframe denoted in the set into the various combinations:

$\{\overline{M}(-2), \overline{M}(0), \overline{M}(1), \overline{M}(5)\}$, $\{\overline{M}(-2), \overline{M}(0), \overline{M}(2), \overline{M}(5)\}$,
$\{\overline{M}(-2), \overline{M}(0), \overline{M}(3), \overline{M}(5)\}$, $\{\overline{M}(-2), \overline{M}(0), \overline{M}(4), \overline{M}(5)\}$,
. . .
$\{\overline{M}(-2), \overline{M}(1), \overline{M}(4), \overline{M}(5)\}$, $\{\overline{M}(-2), \overline{M}(2), \overline{M}(3), \overline{M}(5)\}$,
$\{\overline{M}(-2), \overline{M}(2), \overline{M}(4), \overline{M}(5)\}$, $\{\overline{M}(-2), \overline{M}(3), \overline{M}(4), \overline{M}(5)\}$ The above sets of magnitudes are each produced by applying the quantizer and its inverse on the magnitudes at each of the interpolation points in the set.

The magnitudes for intermediate subframes (i.e. n not in the set $C^k$) are obtained using interpolation. In the first set above, $\overline{M}(-1)$ is formed by interpolating between endpoints $\overline{M}(-2)$ and $\overline{M}(0)$. $\overline{M}(2)$, $\overline{M}(3)$, and $\overline{M}(4)$ are each formed by interpolating between endpoints $\overline{M}(1)$ and $\overline{M}(5)$.

Figure 6:
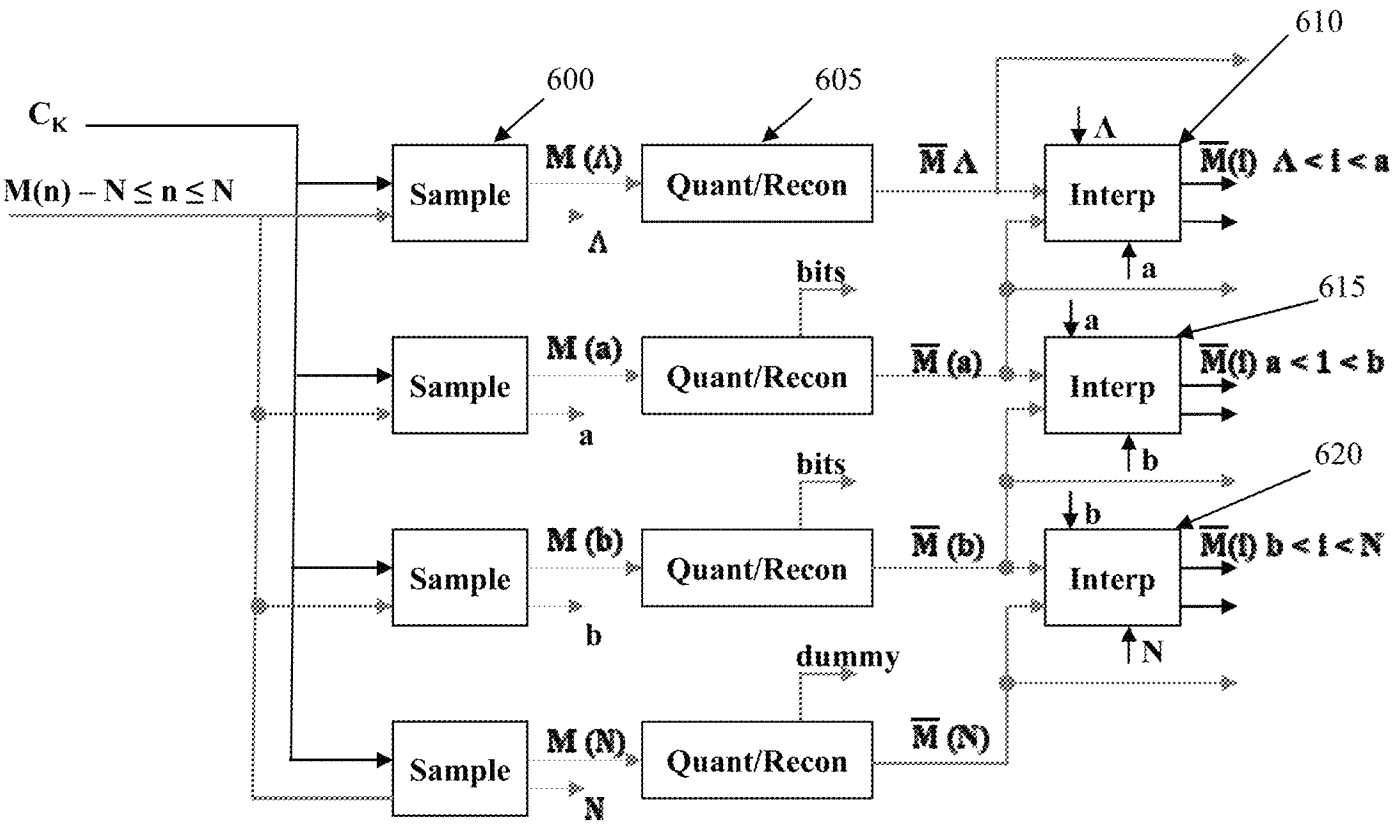
FIG. 6 is a block diagram of a process for interpolating spectral magnitudes for subframes of a frame.

FIG. 6 further illustrates this process, where parameters for subframes ˆ, a, b, and N are sampled (600) and quantized and reconstructed (605), with the quantized and reconstructed samples for parameters ˆ and a being used to interpolate the samples for subframes between ˆ and a (610), the quantized and reconstructed samples for parameters a and b being used to interpolate the samples for subframes between a and b (615), and the quantized and reconstructed samples for parameters b and N being used to interpolate the samples for subframes between b and N (620).

After filling in the intermediate magnitudes for each combination, the procedure 500 evaluates the error for this combination of interpolation points (step 520).

The procedure 500 then increments k (step 525) and determines whether the maximum value of k has been exceeded (step 530). If not, the procedure 500 repeats the quantizing and reconstructing (step 512) for the new value of k and proceeds as discussed above.

If the maximum value of k has been exceeded, the procedure 500 selects the combination of interpolation points ($k_{min}$) that minimizes the error (step 535). The associated bits from the magnitude quantizer, $B_{min}$, and the associated magnitude sampling index, $k_{min}$, are transmitted across the communication channel.

Figure 7:
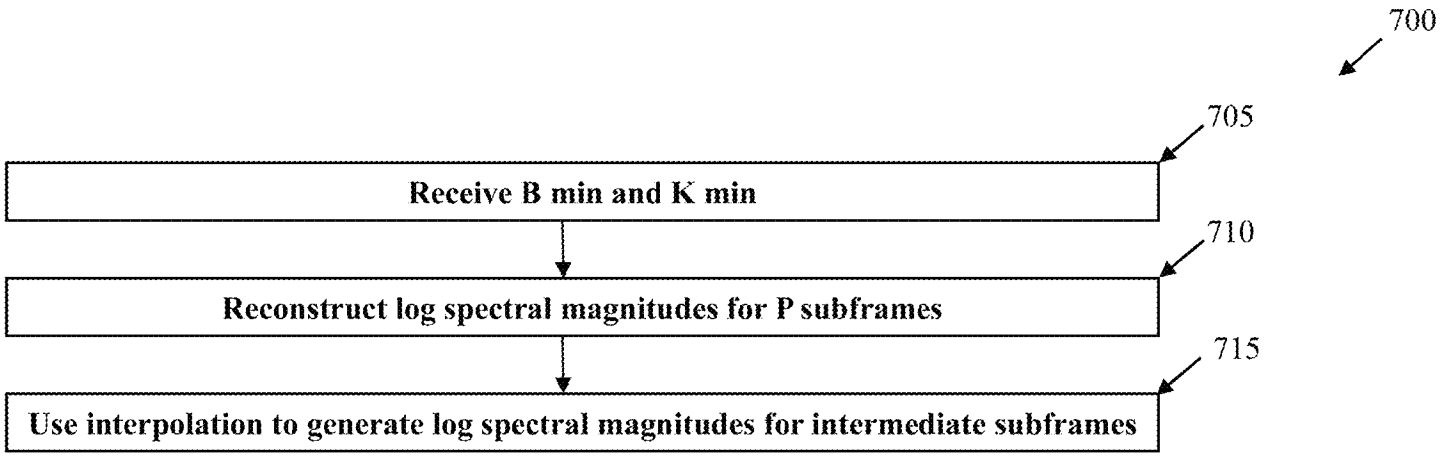
FIG. 7 is a flow chart showing operation of a frame interpolator.

Referring to FIG. 7, the decoder operates according to a procedure 700 that begins with receipt of $B_{min}$ and $k_{min}$ (step 705). The procedure 700 applies the inverse magnitude quantizer to $B_{min}$ to reconstruct the log spectral magnitudes at P, where P≥1, subframe indices (step 710). The received $k_{min}$ value combined with $\Theta_{N,P}^{k_{min}}$ determines the subframe indices of the reconstructed spectral magnitudes. The procedure 700 then reapplies the interpolation equations in order to reproduce the magnitudes at the intermediate subframes (step 715). The decoder must maintain the reconstructed spectral magnitudes for the final interpolation point, $\overline{M}_l(\Lambda)$, in its state. Since each frame will always contain quantized magnitudes for P subframes, the decoder inserts interpolated data at N−P of those subframes such that the decoder can produce N subframes per frame.

Additional implementations may select between multiple interpolation functions rather than using just a single interpolation function for interpolating between two interpolation points. With this variation, the interpolation/quantization error for each combination of interpolation points is evaluated for each permitted combination of interpolation functions. For each interpolation point, an index that selects the interpolation function is transmitted from the encoder to the decoder. If F is used to denote the number of interpolation function choices, then $\log_2 F$ bits per interpolation point are required to represent the interpolation function choice.

For example, if N=5 and P=2 and F=4, then two interpolation points are chosen in each frame containing five subframes, and $\log_2 4=2$ bits are used for each interpolation point to represent the interpolation function chosen for each interpolation point. Since there are two interpolation points per frame, a total of four bits are needed to represent the interpolation function choices in each frame.

Previously the interpolation function, $\overline{M}_l(i)$, was used to define how the magnitudes of the intermediate subframes are derived from the magnitudes at the interpolation points, $\overline{M}(s)$ and $\overline{M}(e)$, with the magnitudes of the interpolated frames being, for example, a linear interpolation of the magnitudes, the log magnitudes, or the squared magnitudes at the interpolation points.

As one example of using multiple interpolation functions, three interpolation functions may be defined as follows:

$\overline{M}_{0,l}(i)=\overline{M}_l(i)$
$\overline{M}_{1,l}(i)=M'_l(e)$
$\overline{M}_{2,l}(i)=M'_l(s)$ where $\overline{M}_{0,l}(i)$ is the same as $\overline{M}_l(i)$ defined previously (a linear interpolation of the magnitudes, the log magnitudes, or the squared magnitudes at the interpolation points). $\overline{M}_{1,l}(i)$ uses the magnitudes at the second interpolation point to fill the magnitudes at all intermediate subframes whereas $\overline{M}_{2,l}(i)$ uses the magnitudes at the first interpolation point to fill all intermediate subframes.

The quantization/interpolation error for each combination of interpolation points is evaluated for each combination of interpolation functions and the combination of interpolation points and interpolation functions that produces the lowest error is selected. A parameter that quantifies the location of the interpolation points is generated for transmission to the decoder along with a parameter that quantifies the interpolation function choice for each subframe. For example, 0 is sent if $\overline{M}_{0,l}(i)$ is selected, 1 is sent if $\overline{M}_{1,l}(i)$ is selected, and 2 is sent if $\overline{M}_{2,l}(i)$ is selected.

Other interpolation techniques that may be employed include, for example, formant interpolation, parameteric interpolation, and parabolic interpolation.

In formant interpolation, the magnitudes at the endpoints are analyzed to find formant peaks and troughs, and linear interpolation in frequency is used to shift the position of moving formants between the two end points. This interpolation method may also account for formants that split or merge.

In parametric interpolation, a parametric model, such as an all pole model, is fitted to the spectral magnitudes at the endpoints. The model parameters then are interpolated to produce interpolated magnitudes from the parameters at intermediate subframes.

Parabolic interpolation uses methods such as those discussed with the magnitudes at three subframes rather than two subframes.

The decoder receives the interpolation function parameter for each interpolation point and uses the corresponding interpolation function to regenerate the same interpolated magnitudes that were chosen by the encoder.

Figure 8:
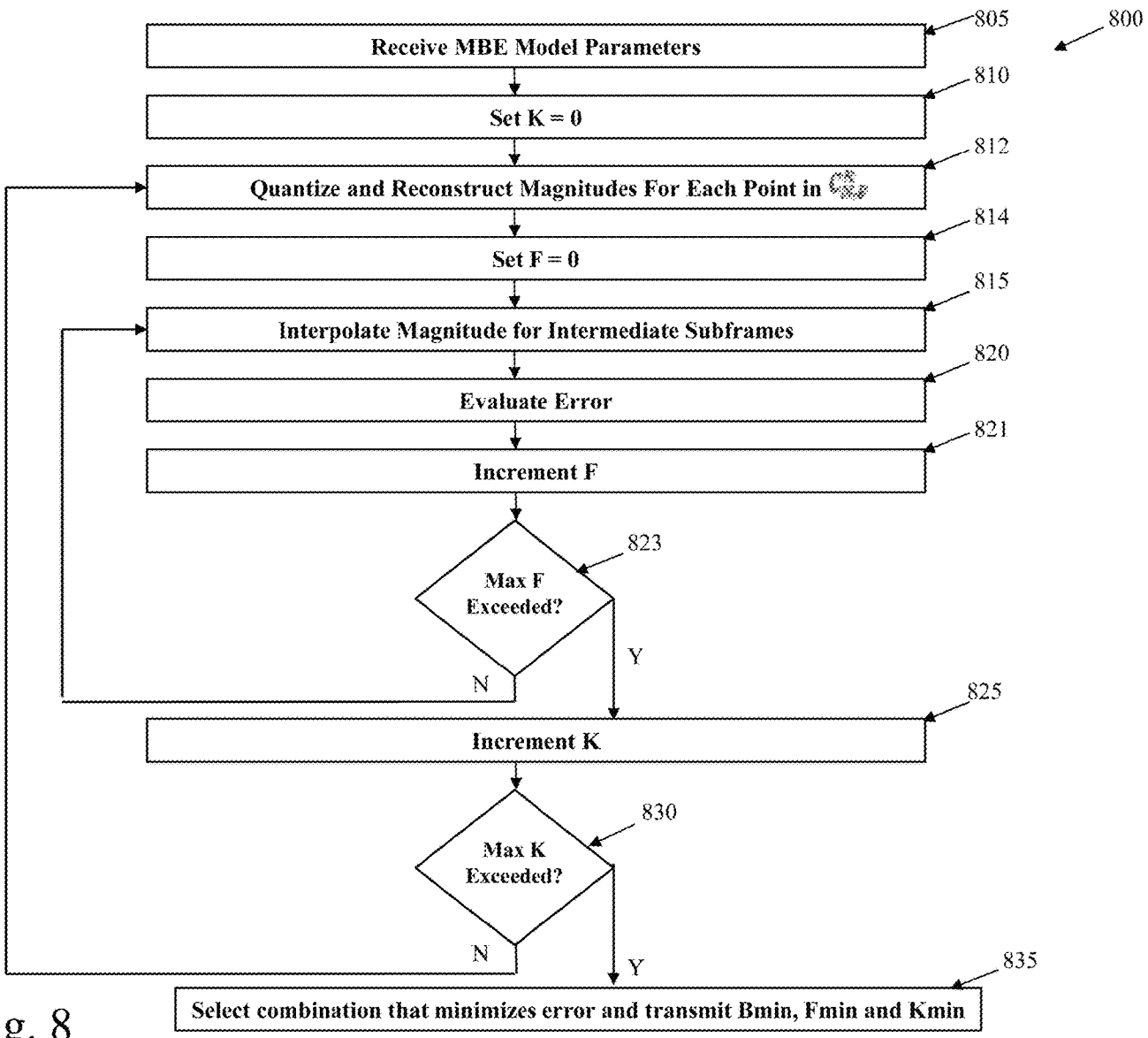
FIG. 8 is a flow chart showing operation of a frame generator.

Referring to FIG. 8, generation of parameters using time varying interpolation points and multiple interpolation functions is conducted according to a procedure 800 that, like the procedure 500, begins with receipt of a set of MBE model parameters estimated for each subframe within a frame (step 805).

The procedure 800 proceeds by setting k to 0 (step 810) and, for each point in $C_{N,P}^{k}$, quantizing and reconstructing the magnitudes (step 812).

The procedure 800 then sets the interpolation function index "F" to 0 (step 814) and interpolates the magnitudes for the intermediate subframes (i.e., n not in the set $C^{k}$) using the interpolation function corresponding to F (step 815).

After filling in the intermediate magnitudes for each combination, the procedure 800 evaluates the error for this combination of interpolation points (step 820).

The procedure 500 then increments F (step 821) and determines whether the maximum value of F has been exceeded (step 823). If not, the procedure 800 repeats the interpolating step using the interpolation function corresponding to the new value of F (step 815) and proceeds as discussed above.

If the maximum value of F has been exceeded, the procedure 800 increments k (step 825) and determines whether the maximum value of k has been exceeded (step 830). If not, the procedure 800 repeats the quantizing and reconstructing (step 812) for the new value of k and proceeds as discussed above.

If the maximum value of k has been exceeded, the procedure 800 selects the combination of interpolation points and the interpolation function that minimize the error (step 835). The associated bits from the magnitude quantizer, the associated interpolation function index, and the associated magnitude sampling index are transmitted across the communication channel.

While the techniques are described largely in the context of a MBE vocoder, the described techniques may be readily applied to other systems and/or vocoders. For example, other MBE type vocoders may also benefit from the techniques regardless of the bit rate or frame size. In addition, the techniques described may be applicable to many other speech coding systems that use a different speech model with alternative parameters (such as STC, MELP, MB-HTC, CELP, HVXC or others) or which use different methods for analysis, quantization. Other implementations are within the scope of the following claims.

What is claimed is:

1. A method of encoding a sequence of digital speech samples into a bit stream, the method comprising:

dividing the digital speech samples into frames including N subframes (where N is an integer greater than 1);

computing model parameters for the subframes, the model parameters including spectral parameters;

generating a representation of the frame, the representation including information representing the spectral parameters of P subframes (where P is an integer and P<N) and information identifying the P subframes, and the representation excluding information representing the spectral parameters of the N−P subframes not included in the P subframes; and encoding the representation of the frame into the bit stream;

wherein generating the representation includes selecting the P subframes by:

for multiple combinations of P subframes, determining an error induced by representing the frame using the spectral parameters for the P subframes and using interpolated spectral parameter values for the N−P subframes, the interpolated spectral parameter values being generated by interpolating using the spectral parameters for the P subframes, and selecting a combination of P subframes as the selected P subframes based on the determined error for the combination of P subframes.

2. The method of claim 1, wherein the multiple combinations of P subframes includes less than all possible combinations of P subframes.

3. The method of claim 1, wherein the model parameters comprise model parameters of a Multi-Band Excitation speech model.

4. The method of claim 1, wherein the information identifying the P subframes is an index.

5. The method of claim 1, wherein generating the interpolated spectral parameter values for the N−P subframes comprises interpolating using the spectral parameters for the P subframes and spectral parameters from a subframe of a prior frame.

6. The method of claim 1, wherein determining an error for a combination of P subframes comprises quantizing and reconstructing the spectral parameters for the P subframes, generating the interpolated spectral parameter values for the P−N subframes, and determining a difference between the spectral parameters for the frame including the P subframes and a combination of the reconstructed spectral parameters and the interpolated spectral parameters.

7. The method of claim 1, selecting the combination of P subframes comprises selecting the combination of P subframes that induces the smallest error.

8. A method for decoding digital speech samples from a bit stream, the method comprising:

receiving a bit stream;

dividing the bit stream into frames of bits;

extracting, from a frame of bits:

information identifying, for which P of N subframes of a frame represented by the frame of bits (where N is an integer greater than 1, P is an integer, and P<N), spectral parameters are included in the frame of bits, and information representing spectral parameters of the P subframes;

reconstructing spectral parameters of the P subframes using the information representing spectral parameters of the P subframes;

generating spectral parameters for the remaining N−P subframes of the frame of bits by interpolating using the reconstructed spectral parameters of the P subframes; and generating audible speech using the reconstructed spectral parameters for the P subframes and the generated spectral parameters for the remaining N−P subframes.

9. The method of claim 8, wherein generating spectral parameters for the remaining N−P subframes of the frame of bits comprises interpolating using the reconstructed spectral parameters of the P subframes and reconstructed spectral parameters of a subframe of a prior frame of bits.

10. A speech coder operable to encode a sequence of digital speech samples into a bit stream by:

dividing the digital speech samples into frames including N subframes (where N is an integer greater than 1);

computing model parameters for the subframes, the model parameters including spectral parameters;

generating a representation of the frame, the representation including information representing the spectral parameters of P subframes (where P is an integer and P<N) and information identifying the P subframes, and the representation excluding information representing the spectral parameters of the N−P subframes not included in the P subframes; and encoding the representation of the frame into the bit stream;

wherein generating the representation includes selecting the P subframes by:

for multiple combinations of P subframes, determining an error induced by representing the frame using the spectral parameters for the P subframes and using interpolated spectral parameter values for the N−P subframes, the interpolated spectral parameter values being generated by interpolating using the spectral parameters for the P subframes, and selecting a combination of P subframes as the selected P subframes based on the determined error for the combination of P subframes.

11. The speech coder of claim 10, wherein the model parameters comprise model parameters of a Multi-Band Excitation speech model.

12. The speech coder of claim 10, wherein generating the interpolated spectral parameter values for the N−P subframes comprises interpolating using the spectral parameters for the P subframes and spectral parameters from a subframe of a prior frame.

13. The speech coder of claim 10, wherein determining an error for a combination of P subframes comprises quantizing and reconstructing the spectral parameters for the P subframes, generating the interpolated spectral parameter values for the P−N subframes, and determining a difference between the spectral parameters for the frame including the P subframes and a combination of the reconstructed spectral parameters and the interpolated spectral parameters.

14. A communication device including the speech coder of claim 10, the communication device further comprising a transmitter for transmitting the bit stream.

15. A handheld communication device including the speech coder of claim 10, the handheld communication device further comprising a transmitter for transmitting the bit stream.

16. A speech decoder operable to decode a sequence of digital speech samples from a bit stream by:

receiving a bit stream;

dividing the bit stream into frames of bits;

extracting, from a frame of bits:

information identifying, for which P of N subframes of a frame represented by the frame of bits (where N is an integer greater than 1, P is an integer, and P<N), spectral parameters are included in the frame of bits, and information representing spectral parameters of the P subframes;

reconstructing spectral parameters of the P subframes using the information representing spectral parameters of the P subframes; and generating spectral parameters for the remaining N−P subframes of the frame of bits by interpolating using the reconstructed spectral parameters of the P subframes; and generating audible speech using the reconstructed spectral parameters for the P subframes and the generated spectral parameters for the remaining N−P subframes.

17. A communication device including the speech decoder of claim 16, the communication device further comprising a receiver for receiving the bit stream and a speaker connected to the speech decoder to generate audible speech based on digital speech samples generated using the reconstructed spectral parameters and the interpolated spectral parameters.

18. A handheld communication device including the speech decoder of claim 16, the handheld communication device further comprising a receiver for receiving the bit stream and a speaker connected to the speech decoder to generate audible speech based on digital speech samples generated using the reconstructed spectral parameters and the interpolated spectral parameters.

* * * * *